US005135049A

United States Patent [19]

Attinger et al.

[11] Patent Number: 5,135,049

[45] Date of Patent: Aug. 4, 1992

[54] VENT LINE IN THE COOLING CIRCUIT OF AN INTERNAL COMBUSTION ENGINE

[75] Inventors: Thomas Attinger, Stuttgart; Wolfgang Kleineberg, Calw; Hans Schaal, Esslingen, all of Fed. Rep. of Germany

[73] Assignee: Mercedes-Benz AG, Fed. Rep. of Germany

[21] Appl. No.: 732,414

[22] Filed: Jul. 18, 1991

[30] Foreign Application Priority Data

Aug. 8, 1990 [DE] Fed. Rep. of Germany ..... 4025067

[51] Int. Cl.[5] ..... F01P 11/02

[52] U.S. Cl. ..... 165/104.32; 123/41.51; 123/41.54

[58] Field of Search ..... 165/104.32; 123/41.54, 123/41.51, 41.27

[56] References Cited

U.S. PATENT DOCUMENTS 3,741,172 7/1973 Andreux ..... 123/41.54
3,820,593 6/1974 Pabst ..... 123/41.54
4,677,943 7/1987 Skinner ..... 123/41.27

FOREIGN PATENT DOCUMENTS 3920898 7/1990 Fed. Rep. of Germany ... 123/41.54
1270238 4/1972 United Kingdom ..... 123/41.54

*Primary Examiner*—Albert W. Davis, Jr.
*Attorney, Agent, or Firm*—Evenson, Wands, Edwards, Lenahan & McKeown

[57] ABSTRACT

A venting arrangement for a cooling circuit of an internal combustion engine, having a vent line which connects a radiator to a top section of an expansion tank located at a higher level with regard to the top of the radiator. In order to avoid trapping of air inside the vent line, a vent valve in the form of a flap or diaphragm valve is installed at the highest point of the vent line, via which vent valve the trapped air can escape during travelling operation and during filling. By the arrangement of the vent valve inside the expansion tank, the cooling water expanding during running of the engine and discharging via the vent valve remains in the expansion tank.

6 Claims, 2 Drawing Sheets

VENT LINE IN THE COOLING CIRCUIT OF AN INTERNAL COMBUSTION ENGINE

BACKGROUND AND SUMMARY OF THE INVENTION

The present invention relates to a vent line in the cooling circuit of an internal combustion engine, the vent line connecting a radiator to a top section of an expansion tank located at a higher level with regard to the top of the radiator. An angled pipe element of the vent line dips into the expansion tank at a top section, the angled pipe element having an opening in the vicinity of the tank bottom.

U.S. Pat. No. 4,677,943 discloses a vent line of the above type. In this arrangement, it is disadvantageous that the air volume into the expansion tank by the expansion of the cooling water is held back in the vent line by the geodetic back pressure of the cooling water located in the expansion tank. This air volume remaining in the vent line is drawn in by the water pump when the engine is restarted. Damage to the pump consequently occurs, the entire cooling circuit being disturbed.

An object of the present invention is to provide a bent line to be installed between an expansion tank and a radiator, in which vent line the trapping of an air volume is avoided.

This and other objects are achieved by the present invention which provides a venting arrangement in a cooling circuit of an internal combustion engine, and has an expansion tank and a vent line that couples the top section of the expansion tank with a radiator of the cooling circuit. The vent line is at least as high as a top of the radiator, and has an angled pipe element that dips into the expansion tank at the top section. The angled pipe element has an opening in the vicinity of a bottom of the expansion tank. The vent line also has a pipe section which lies in the expansion tank and is coupled to the angled pipe element, and a vent valve that is arranged at a highest point of the vent line.

In effect, a vent valve is installed at the highest point of the vent line. Via this vent valve, the air displaced during travelling operation from the radiator and during the filling of the expansion tank and the radiator can escape. The pipe element of the vent line, (the pipe element containing the vent valve), is arranged in an advantageous manner inside the expansion tank so that the cooling water expanding during the running of the engine and discharging via the vent valve remains in the expansion tank.

Other objects, advantages and novel features of the present invention will become apparent from the following detailed description of the invention when considered in conjunction with the accompanying drawings.

DETAILED DESCRIPTION OF THE DRAWINGS

Figure 1:
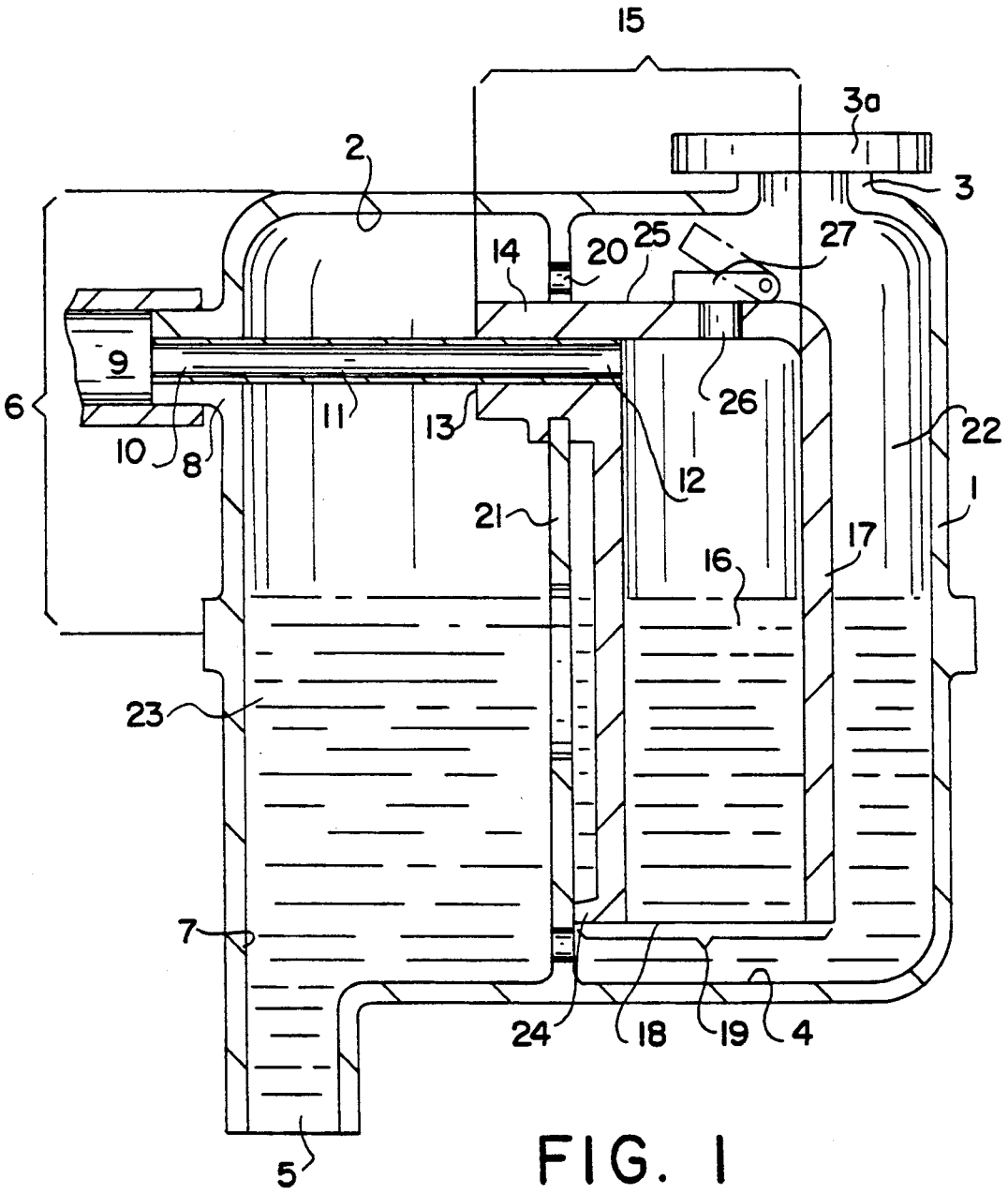
FIG. 1 shows a longitudinal section of an expansion tank having a vent line and a flap as a vent valve constructed in accordance with an embodiment of the present invention.

FIG. 1 shows an expansion tank 1 which has at its top 2 a filler socket 3 having a cap 3*a*. Located diametrically opposite the filler socket 3 on the bottom 4 of the tank 1 is a socket 5 for attaching an expansion line connected to the radiator (not shown) of the internal combustion engine. A connecting socket 8 pointing to the outside is located in a top section 6 on a side wall 7 of the tank 1. A vent line 9 is attached to the connecting socket 8. The vent line 9, which is only partly shown here, connects a top area of the radiator to the top section 6 of the expansion tank 1, the connecting socket 8 lying at least at the same level as the top of the radiator.

Figure 2:
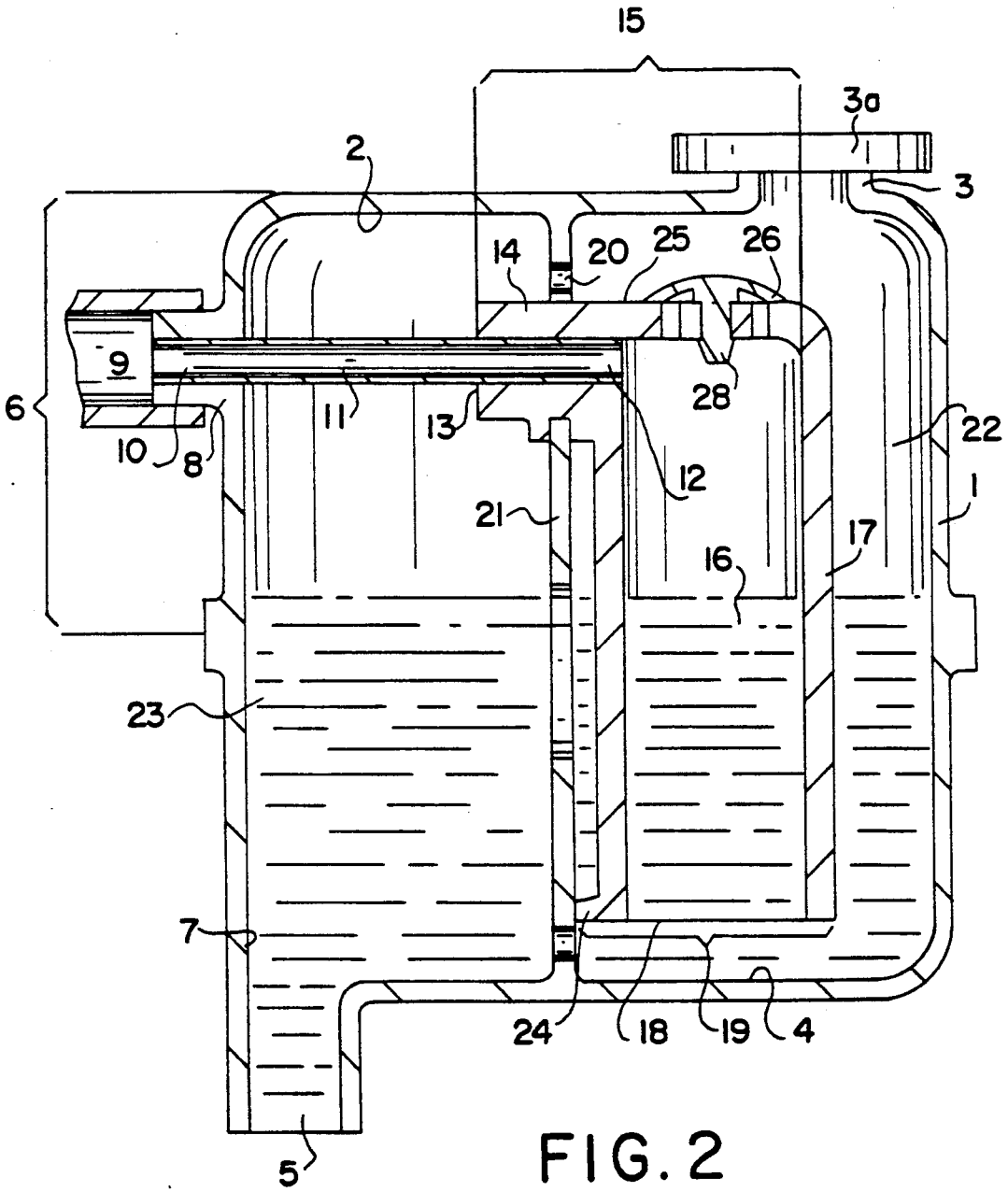
FIG. 2 shows another embodiment of the expansion tank similar to FIG. 1 but having a diaphragm valve as a vent valve.

Fitted into the connecting socket 8 is one end 10 of a further pipe 11 which runs horizontally in the tank 1 and, with another end 12, is enclosed by an opening 13 of a top end 14 of a horizontally disposed part 15 of a right-angled pipe element 16. The pipe element 16 leads with its vertical part 17 into the vicinity of the tank bottom 4, where it has a bottom opening 18. An underside 19 of the horizontally disposed part 15 is inserted in a lead-through aperture 20 of an intermediate wall 21 which divides the tank 1 into two chambers 22, 23 in connection with one another. Furthermore, the vertical part 17 is supported against the intermediate wall 21 by a web 24 made in the area of the bottom opening 18 of the pipe element 16. In an upper side 25 of the horizontally disposed part 15, an opening 26 is arranged opposite the bottom opening 18. The opening 26, depending on the state in the cooling circuit, is closed or cleared by a flap 27 acting as a vent valve. In an alternate embodiment, illustrated in FIG. 2, the opening 26 is controlled by a mushroom-shaped diaphragm valve 28 made of silicone When the cooling circuit is filled via the filler socket 3, the flap 27 for the diaphragm valve 28 is opened by the air displaced by the water when the filling level has reached the bottom opening 18 of the pipe element 16. The air trapped in the pipe element 16 by the filling level, rising during further refilling, then escapes via the vent valve 27 or 28 into the chambers 22, 23 of the tank 1 and from there to the outside via a pressure-relief valve (not specifically shown) located in the cap 3*a* of the filler socket 3. In the process, the tank 1 is filled until the water has reached the upper side 25 of the horizontally disposed part 15 of the right-angled pipe element 16 and has thus reached the highest point of the entire vent line 9.

During travel, air from the radiator is displaced with the cooling water into the vent line 9, the right-angled pipe element 16 representing a stabilizing space for the incoming air. From the stabilizing space the air can escape via the vent valve 27 or 28. In order to act as a stabilizing space, the cross-section of the vertical part 17 of the right-angled pipe element 16 must be greater than the cross-section of the horizontally disposed part 15.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A venting arrangement in a cooling circuit of an internal combustion engine, comprising:

an expansion tank having a top section; and a vent line that couples the top section of the expansion tank with a radiator of the cooling circuit, the vent line being at least as high as a top of the radiator, the vent line having:

an angled pipe element that dips into the expansion tank at the top section, the angled pipe element having an opening in the vicinity of a bottom of the expansion tank;

a pipe section which lies in the expansion tank and is coupled to the angled pipe element; and a vent valve that is arranged at a highest point of the vent line.

2. The arrangement of claim 1, wherein the angled pipe element has a horizontally disposed part with an upper side that has an opening, and the vent valve is a flap which is attached to the upper side of the horizontally disposed part of the angled pipe element, the flap closing the opening in the upper side and being openable towards a top of the expansion tank.

3. The arrangement of claim 2, wherein the angled pipe element has a horizontally disposed part with an upper side that has an opening, and the vent valve is a diaphragm valve made of silicone and which is attached to the upper side of the horizontally disposed part of the angled pipe element, the diaphragm closing the opening in the upper side and being openable towards a top of the expansion tank.

4. The arrangement according to claim 3, wherein the expansion tank includes an intermediate wall having a lead-through aperture, the intermediate wall extending perpendicularly in the expansion tank, and said angled pipe element is fastened to the intermediate wall inside the lead-through aperture.

5. The arrangement according to claim 4, wherein the pipe section includes a horizontally running pipe with first and second ends, the angled pipe element having a top end with an opening, the first end of the horizontally running pipe being fitted in the opening of the top end of the angled pipe element, the expansion tank having a side wall with a connecting socket which is at the same vertical level as the vent line, the connecting socket connecting the vent line to the second end of the horizontally running pipe and pointing to the outside of the expansion tank.

6. The arrangement of claim 5, wherein the angled pipe element has a vertical part with a cross-section greater than a cross-section of the horizontally disposed part.

* * * * *